US010969117B2

(12) United States Patent
Chen

(10) Patent No.: US 10,969,117 B2
(45) Date of Patent: Apr. 6, 2021

(54) EXTENDIBLE AND RETRACTABLE COOKING SMOKE SHIELDING AND GUIDING APPARATUS

(71) Applicant: Yu-Shu Chen, Taipei (TW)

(72) Inventor: Yu-Shu Chen, Taipei (TW)

( * ) Notice: Subject to any disclaimer, the term of this patent is extended or adjusted under 35 U.S.C. 154(b) by 91 days.

(21) Appl. No.: 16/551,222

(22) Filed: Aug. 26, 2019

(65) Prior Publication Data

US 2021/0063022 A1 Mar. 4, 2021

(51) Int. Cl.

| | |
|---|---|
| ***F24C 15/28*** | (2006.01) |
| ***F24C 15/12*** | (2006.01) |
| ***B08B 15/02*** | (2006.01) |
| ***F24C 15/20*** | (2006.01) |
| ***B08B 17/02*** | (2006.01) |

(52) U.S. Cl.

CPC ..... *F24C 15/28* (2013.01); *B08B 15/02* (2013.01); *B08B 17/025* (2013.01); *F24C 15/12* (2013.01); *F24C 15/20* (2013.01); *B08B 2215/00* (2013.01)

(58) Field of Classification Search

CPC ..... F24C 15/28; F24C 15/12; F24C 15/20; B08B 15/02; B08B 17/025; B08B 2215/00

See application file for complete search history.

(56) References Cited

U.S. PATENT DOCUMENTS

| | | | | |
|---|---|---|---|---|
| 2,081,640 | A * | 5/1937 | Petersen | F24C 15/2007 126/299 R |
| 3,814,078 | A * | 6/1974 | Etzcorn | F24C 15/12 126/299 C |
| 4,155,343 | A * | 5/1979 | Hartman | F24C 15/36 126/211 |
| 4,422,441 | A * | 12/1983 | Schoepe | F24C 15/12 126/299 C |
| 5,967,136 | A * | 10/1999 | Gray | F24C 15/2042 126/299 C |
| 6,371,105 | B1 * | 4/2002 | Merritt | F24C 15/12 126/211 |
| 9,335,057 | B2 * | 5/2016 | Bagwell | F15D 1/02 |
| 9,890,958 | B2 * | 2/2018 | Duong | F24C 15/28 |
| 10,378,776 | B2 * | 8/2019 | Luk | F24C 15/12 |
| 2017/0205081 | A1 * | 7/2017 | Duong | F24C 15/2092 |
| 2017/0292715 | A1 * | 10/2017 | Flores | F24C 15/12 |
| 2018/0149367 | A1 * | 5/2018 | Faulstich | A47J 37/1271 |

* cited by examiner

*Primary Examiner* — David J Laux
(74) *Attorney, Agent, or Firm* — Wang Law Firm, Inc.

(57) ABSTRACT

A cooking smoke shielding and guiding apparatus comprises: a housing including an outer casing, a storing chamber defined in the outer casing and having a slot formed in an end portion of the outer casing, and a plurality of fixing elements formed on said outer casing adapted for fixing the outer casing on a kitchen object by the fixing elements; a shielding plate slidably retractably stored in the storing chamber of the housing or slidably extended outwardly through the slot of the outer casing for shielding and guiding cooking smoke; and a driving mechanism mounted in the storing chamber and operatively extending the shielding plate outwardly from the storing chamber, or operatively retracting the shielding plate inwardly into the storing chamber.

10 Claims, 11 Drawing Sheets

EXTENDIBLE AND RETRACTABLE COOKING SMOKE SHIELDING AND GUIDING APPARATUS

BACKGROUND OF THE INVENTION

In order to draft the smokes, fumes, odors or waste gas outwardly from a kitchen, an exhaust system may be installed in the kitchen for exhausting the smokes or waste gas (such as from a gas stove or range) outwardly for keeping a clean air in the kitchen or room.

However, a conventional kitchen exhaust system including exhaust hood and fan is separately installed above the stove or oven. During cooking in the kitchen, the smokes or waste gas (when a gas stove is used) may be spread sidewardly to cause pollution in the kitchen or room because there is a distance between the stove and the exhaust hood of the exhaust system. Before being sucked and exhausted by the exhaust system, the smokes or waste gas will be spread from the stove into the surroundings to cause pollution because there is no shield or baffle provided around the stove for shielding the smokes or waste gas.

The present inventor has found the drawbacks of a conventional kitchen exhaust system, and invented the present extendible and retractable cooking smoke shielding and guiding apparatus, in order to efficiently shield, guide, and draft the kitchen smokes and waste gas outwardly for keeping a non-polluted environment in a kitchen or home.

SUMMARY OF THE INVENTION

The object of the present invention is to provide a cooking smoke shielding and guiding apparatus comprising: a housing including an outer casing, a storing chamber defined in the outer casing and having a slot formed in an end portion of the outer casing, and a plurality of fixing elements formed on said outer casing adapted for fixing the outer casing on a kitchen object by the fixing elements; a shielding plate slidably retractably stored in the storing chamber of the housing or slidably extended outwardly through the slot of the outer casing for shielding and guiding cooking smoke; and a driving mechanism mounted in the storing chamber and operatively extending the shielding plate outwardly from the storing chamber, or operatively retracting the shielding plate inwardly into the storing chamber.

According to the present invention, there is provided with an apparatus, wherein the driving mechanism comprises: a driving motor, a winch driven by the driving motor; a guiding rail formed in a central portion in the outer casing and having a first roller rotatably mounted on a first end portion of the guiding rail and a second roller rotatably mounted on a second end portion of the guiding rail opposite to the first guiding roller; a sliding block having the shielding plate secured on the sliding block and slidably moving on the guiding rail to cooperatively move the shielding plate with respective to the guiding rail; a rope wound on the winch and having a first rope end secured to the sliding block facing towards the first end portion of the guiding rail and having a second rope end secured to the sliding block facing towards the second end portion of the guiding rail, whereby upon rotation of the driving motor and the winch either clockwise or counter-clockwise, the rope will be pulled by the winch to move the sliding block and the shielding plate either towards the first end portion or towards the second and portion of the guiding rail.

According to this invention, there is provided with a fixing element including hook, bracket, or holes for fixing the housing on a kitchen object by screws, bolts, etc. According to this invention, the outer casing comprises a pair of side rails disposed on opposite sides of the storing chamber for slidably moving the shielding plate along the pair of side rails.

In this invention, a buffer member is provided between the shielding plate and each side rail.

In this invention, the housing further comprises a decorative plate covering an outer end portion of said outer casing.

Still, the decorative plate includes a control switch of the driving mechanism mounted on the decorative plate.

According to this invention, the outer casing includes a dust-proof plate pivotally secured to the outer casing, and resiliently restored inwardly as restored by a restoring spring formed on a bottom portion of the outer casing to normally close the slot in the outer casing.

In this invention, the shielding plate is made of transparent material, and further includes an illuminator mounted on the shielding plate for projecting lights sidewardly or outwardly.

In this invention, the shielding plate includes a display adapted for displaying a signal as input by a user into said display. Such a display may be linked by wired, or wireless (such as Bluetooth) signal connection between a user's mobile device and the display so as to input signals, message, information, recipes, movies, or programs into the display.

In this invention, the driving mechanism is controlled by a wired or wireless signal control. Also plural cooking smoke shielding and guiding apparatuses may be synchronously cooperatively operated as controlled by a plurality of the driving mechanisms.

The kitchen object may refer to a housing of an exhaust system, a cabinet, a counter, or a kitchen wall.

DETAILED DESCRIPTION

Figure 1:
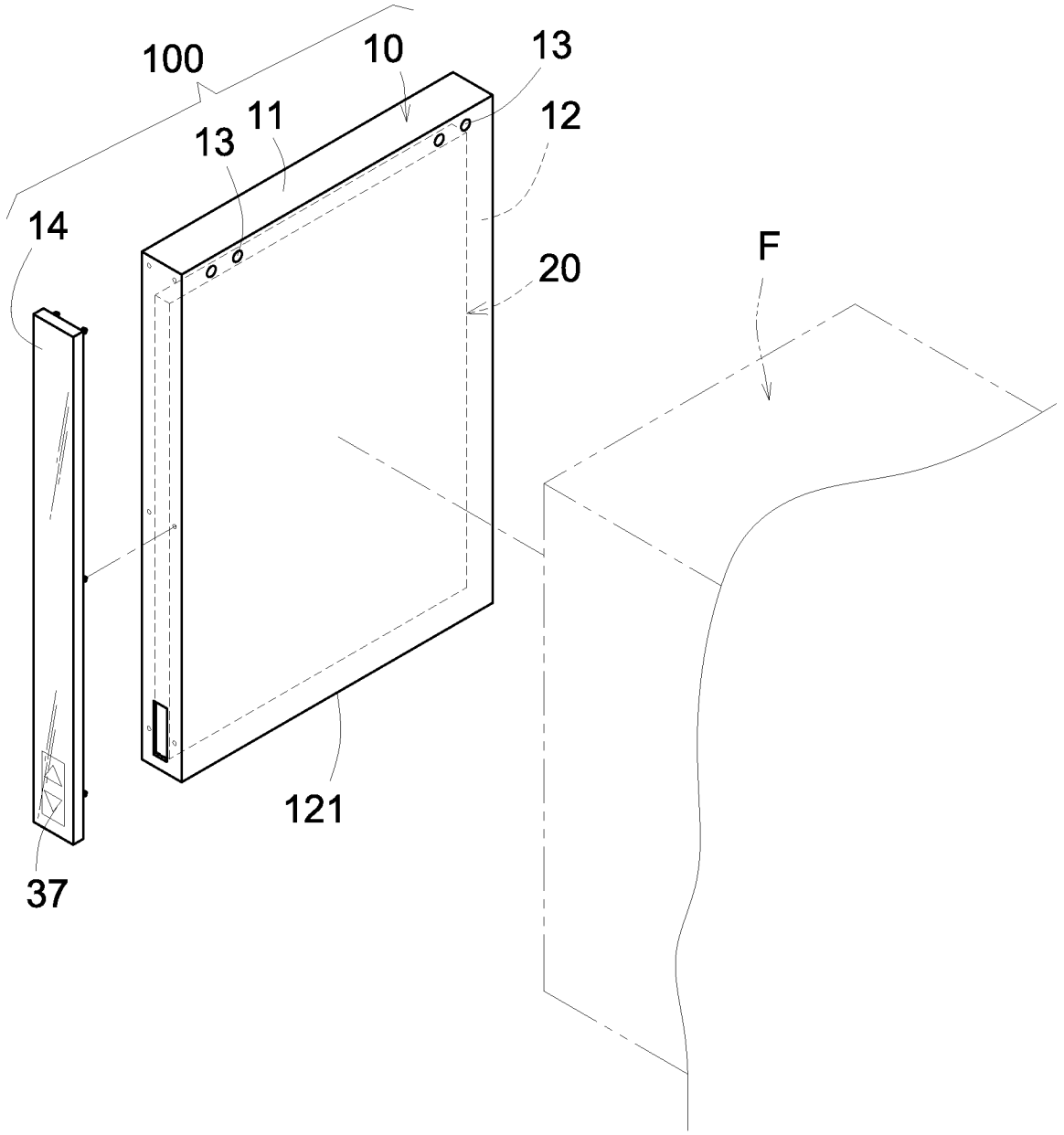
FIG. 1 is a partial cut-away perspective illustration of the present invention.

As shown in FIGS. 1-6, the cooking smoke shielding and guiding apparatus 100 of the present invention comprises: a housing 10 including an outer casing 11, a storing chamber 12 formed in the outer casing 11 and having a slot 121 formed in an end of the storing chamber 12; and a plurality of fixing elements 13 formed in the outer casing 11 for fixing the housing 10 on a kitchen object F; a shielding plate 20 movably stored in the storing chamber 12; and a driving mechanism 30 mounted in the storing chamber 12 of the housing 10 for operatively extending the shielding plate 20 outwardly through the slot 121 for shielding or deflecting cooking smoke in a kitchen, or for operatively retracting the shielding plate 20 inwardly into the storing chamber 12 of the housing 10.

Figure 3:
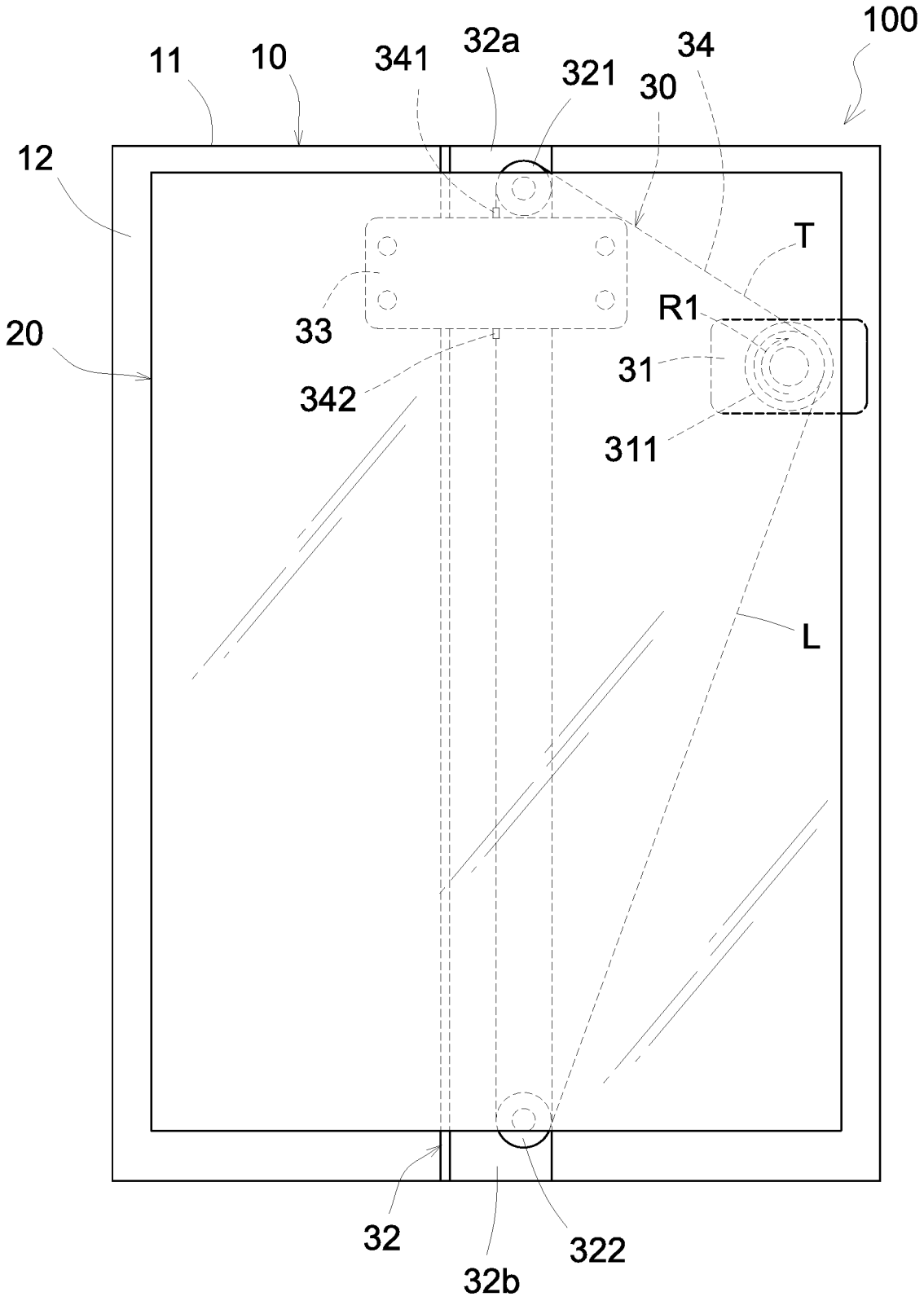
FIG. 3 is an illustration showing the driving mechanism of the present invention.
Figure 4:
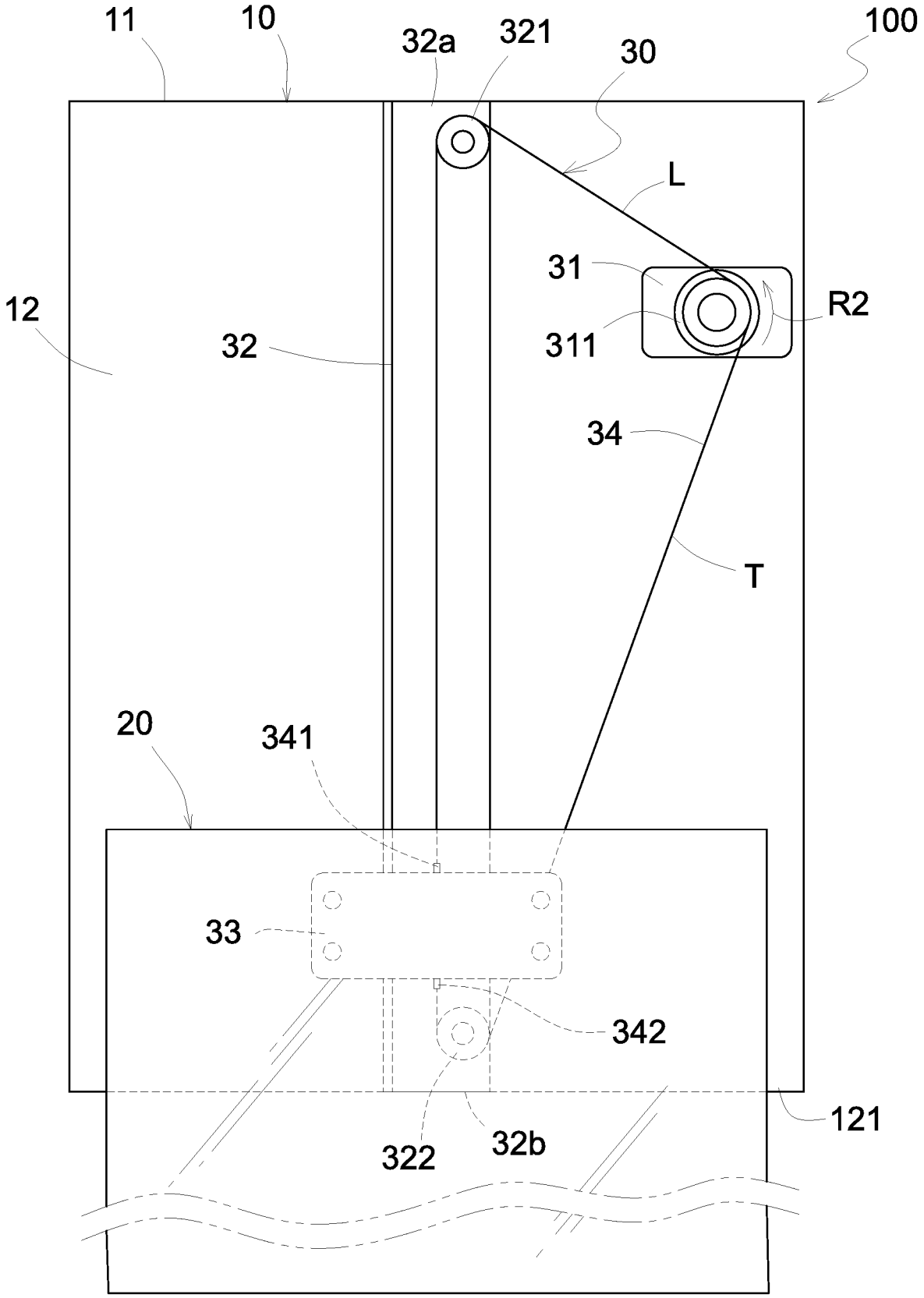
FIG. 4 is an illustration showing the shielding plate extended outwardly from FIG. 3.

As shown in FIGS. 3 and 4, the driving mechanism 30 of the smoke shielding and guiding apparatus 100 of the present invention comprises: a driving motor 31 mounted in the housing 10, a winch 311 driven by the driving motor 31, a guiding rail 32 formed or vertically formed in a central portion in the housing 10 and having an upper roller (or a first roller) 321 formed on an upper (or a first) portion of the guiding rail 32 and a lower (or second) roller 322 formed on a lower (or second) portion of the guiding rail 32; a sliding block 33 secured with the shielding plate 20 on the sliding block 33 and slidably moving on the guiding rail 32; a rope 34 wound on the winch 311 and having a first rope end 341 secured to the sliding block 33 facing towards an upper (or first) end 32*a* of the guiding rail 32, and having a second rope end 342 secured to the sliding block 33 facing towards a lower (or second) end 32*b* of the guiding rail 32; whereby upon a clockwise rotation of the driving motor 31 in a clockwise direction R1 to cooperatively wind the winch 311 (also in direction R1) as shown in FIG. 3, the rope 34 with the first rope end 341 secured to the sliding block 33 will form a tension rope section T of the rope 34 between the winch 311 and the first rope end 341 as wound across the upper roller 321, while forming a loose rope section L between the winch 311 and the second rope end 342 as wound across the lower roller 322, to thereby retract the sliding block 33 and the shielding plate 20 into the storing chamber 12 in the outer casing 11 of the housing 10; and whereby upon a counter-clockwise rotation of the motor 31 and winch 311 in a counter-clockwise direction R2 as shown in FIG. 4, the rope 34 with the second rope end 342 secured to the sliding block 33 will form another tension rope section T between the winch 311 and the second rope end 342 as wound across the lower roller 322, while forming another loose rope section L between the winch 311 and the first rope end 341 as wound across the upper roller 321, to thereby extend the sliding block 33 and the shielding plate 20 outwardly beyond the slot 121 of the outer casing 11 of the housing 10 for shielding or deflecting cooking smoke in a kitchen.

Figure 2:
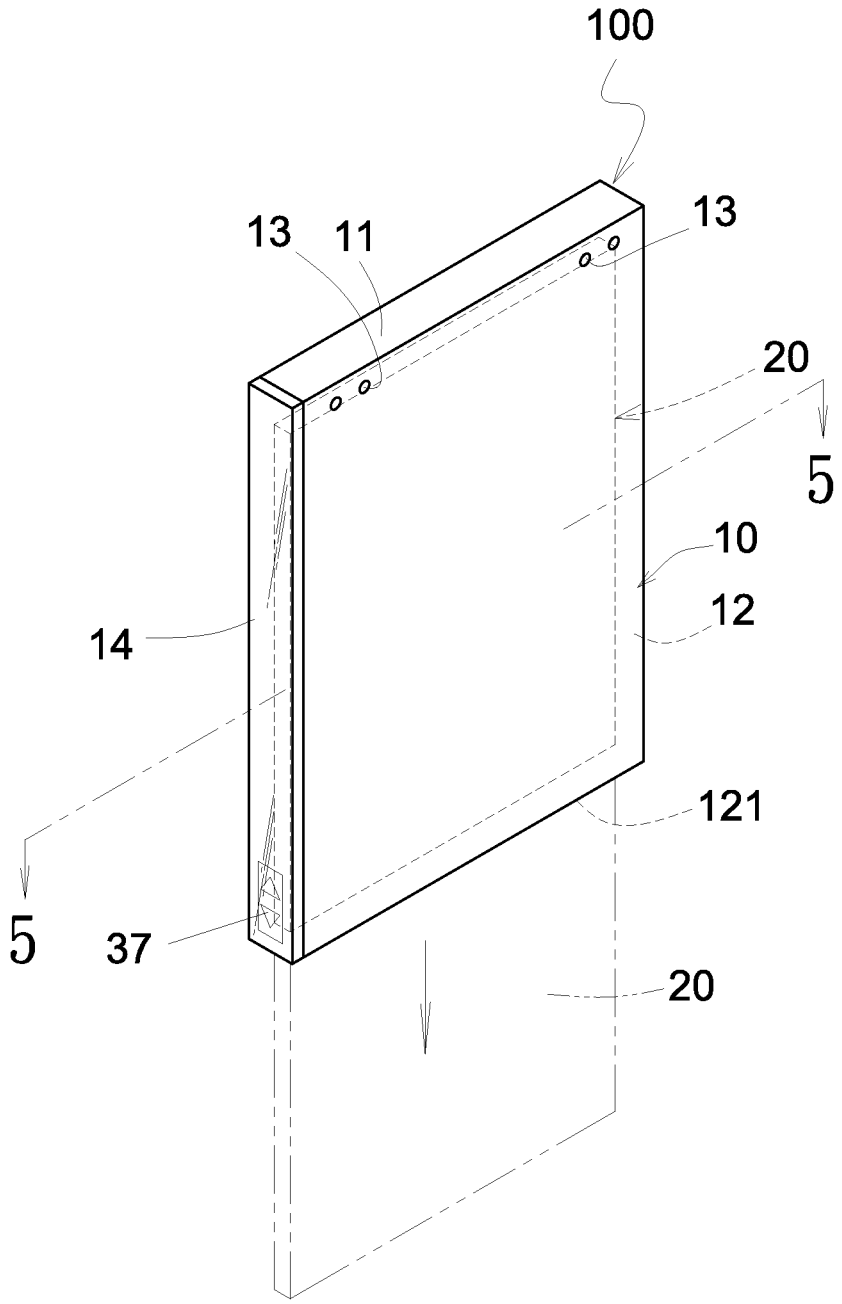
FIG. 2 is a perspective view of the present invention when downwardly extending the shielding plate.

As shown in FIGS. 1 and 2, the fixing element 13 may be a hanger, a hook, a bracket, a screw hole, or a nail hole, adapted for fixing the housing 10 on a kitchen object F by bolt, screw, nail or any other devices. The fixing elements 13 are not limited in this invention.

Figure 5:
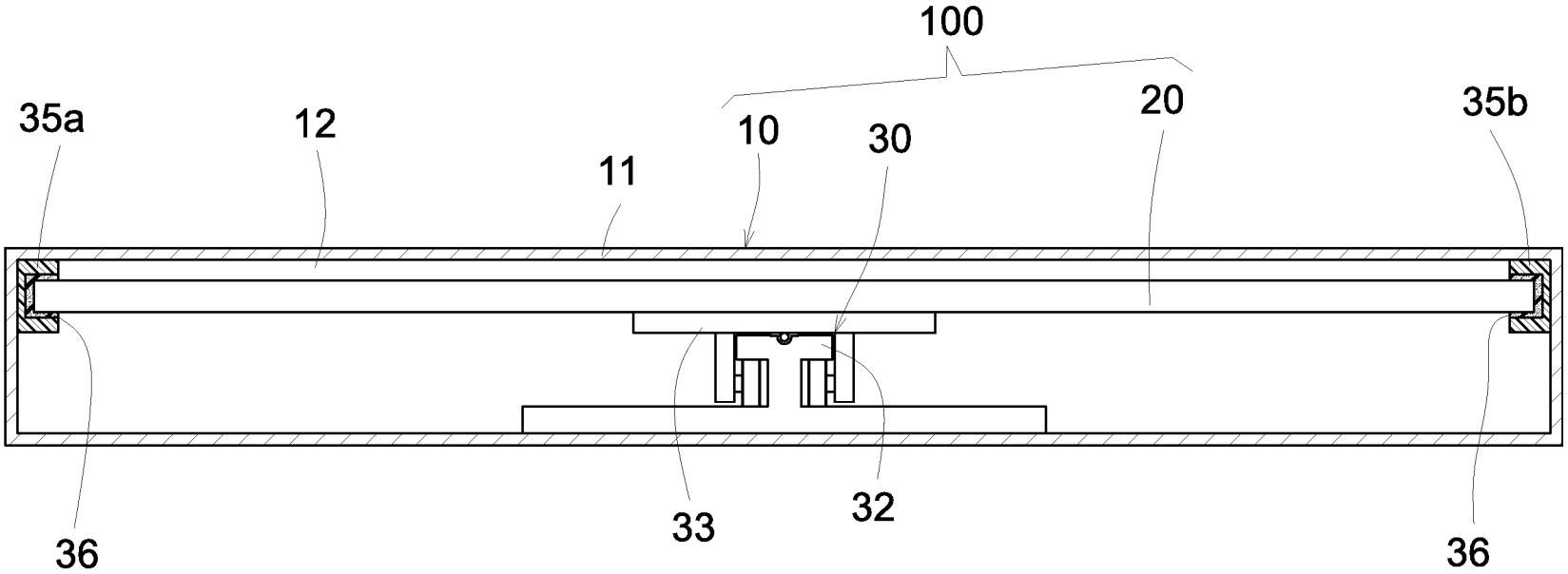
FIG. 5 is a sectional drawing as viewed from Line 5-5 of FIG. 2.

As shown in FIG. 5, a pair of side rails 35*a*, 35*b* are provided in the storing chamber 12 and disposed on opposite sides of the housing 10 to help guide the opposite end portions of the shielding plate 20 to be slidably moved within the opposite side rails 35*a*, 35*b*. A buffer member 36 is packed in between the shielding plate 20 and each side rail 35*a* or 35*b* to prevent from frictional wearing during sliding movements of the shielding plate 20 within the side roils 35*a*, 35*b*, thereby keeping a beautiful appearance of the shielding plate 20.

As shown in FIGS. 1 and 2, the housing 10 further includes a decorative plate 14 covering an outer end portion of the housing 10 for ornamental purpose when installing the present invention on a kitchen object F such as a cabinet or other kitchen equipments. A control switch 37 of the driving mechanism 30 may be mounted on the decorative plate 14 of the present invention 30 so as to control the outward extending or inward retracting movements of the shielding plate 20 within the housing 10.

Figure 11:
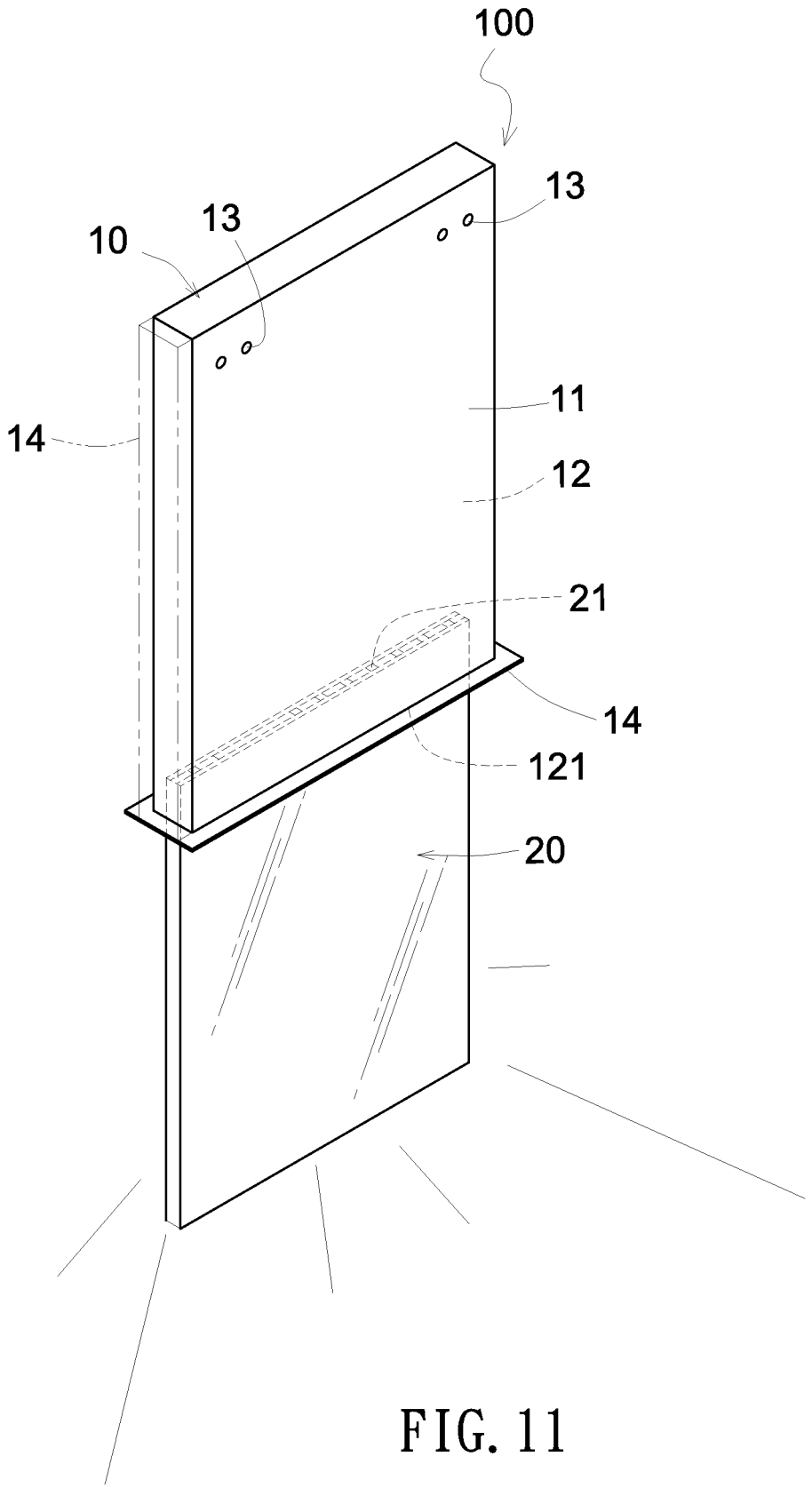
FIG. 11 shows an illuminator provided on the shielding plate in accordance with the present invention.

As shown in FIGS. 1 and 2, the decoration plate 14 is mounted on an outer end portion of the outer casing 11 of the housing 10. Or, the decorative plate 14 may be mounted on a bottom edge portion of the housing 10 adjacent to the slot 121 as shown in FIG. 11. Upon installation of the present invention on the kitchen object F, the decorative plate 14 may be well decorated in consideration of colors, patterns, designs or personal favorite styles to reveal overall beautiful decorative features of the kitchen art or appearance.

Figure 6:
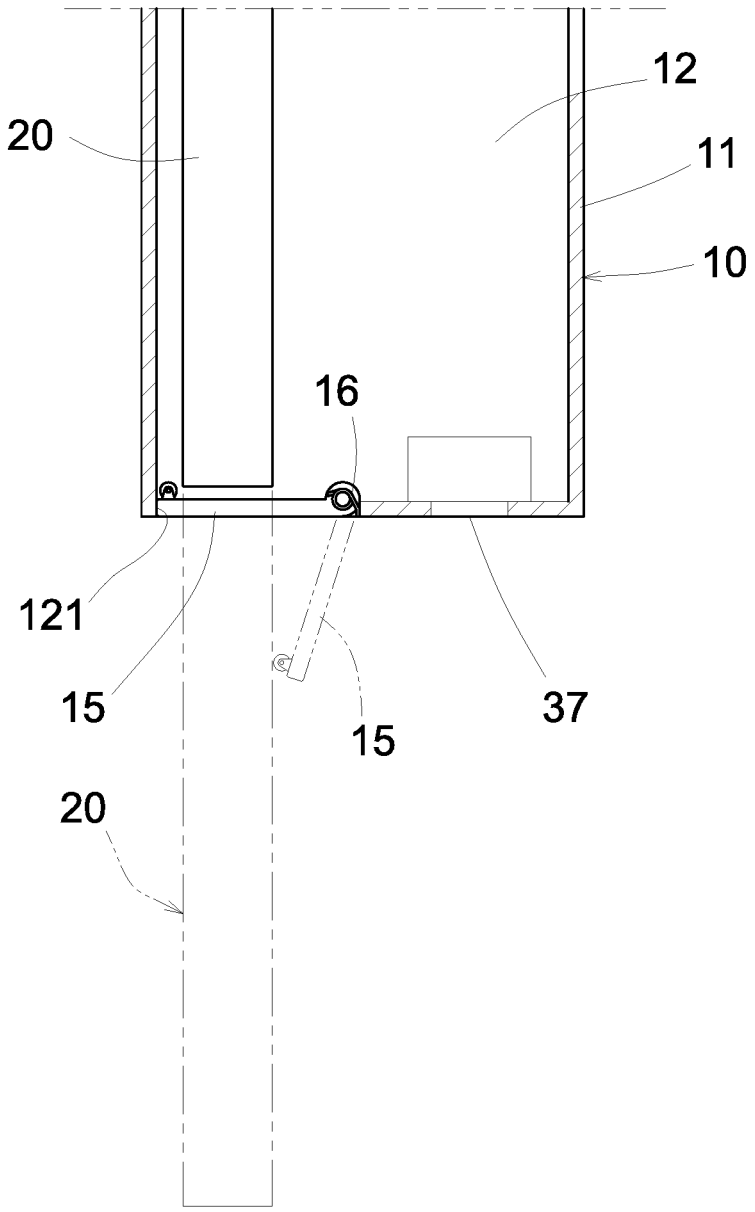
FIG. 6 shows the dust-proof plate normally closing the slot of casing and operatively opened when extending the shielding plate (as dotted line shown).

As shown in FIG. 6, the present invention further includes a dust-proof plate 15 pivotally secured to said outer casing and resiliently inwardly restored to normally close the slot 121 of the outer casing 11 of the housing 10 as restored by a restoring spring 16 formed in a bottom portion of the outer casing 11 adjacent to the slot 121. Upon outward extending of the shielding plate 20 through the slot 121, the dust-proof plate 15 may be pushed outwardly (or downwardly) by the outward (or downward) moving of plate 20 to open the slot 121. Upon retraction of the shielding plate 20 into the storing chamber 12 of the casing 11, the dust-proof plate 15 will be inwardly (or upwardly) restored by the restoring spring 16 to finally close the slot 121 when the shielding plate 20 is retracted inwardly (or upwardly) completely. Therefore, a flat and smooth appearance of the present invention (when the dust-proof plate 15 is closed) will be presented to be commensurate with the flat and smooth appearance of the kitchen cabinet, counter or other kitchen equipments.

As shown in FIG. 11, the shielding plate 20 may be made of transparent materials, including glass, acrylic, poly-carbonate, etc. Or, an illuminator 21 may be mounted on or in the shielding plate 20 which is transparent so that the light as emitted from the illuminator 21 may be transmitted, reflected, deflected, or spread in plural directions through the transparent shielding plate 20 to reveal an optical illuminative and decorative effect for the present invention.

The shielding plate 20 may be formed as a display for LED, DLED or other display devices. Such a display formed on the shielding plate 20 may serve as a message or memo board for inputting a signal or leaving a message on the display or may serve as a "screen" showing a recipe as downloaded from an internet for cooking reference in a kitchen. The display on the shielding plate 20 may be electronically connected with a mobile device such as a cell phone or mobile phone by a wired or wireless signal connection such as by a Bluetooth so as to input signal into the display.

Figure 9:
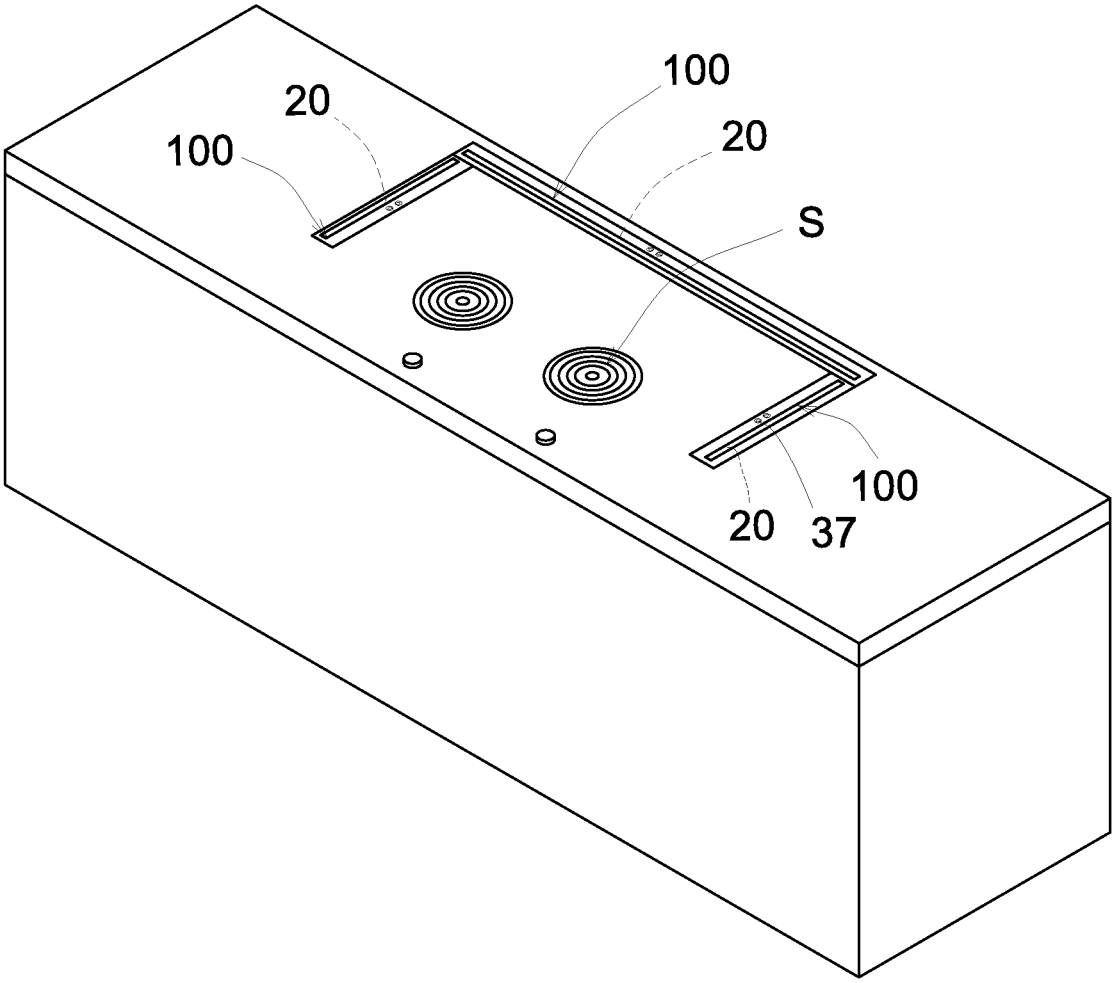
FIG. 9 shows three shielding plates provided for the present invention, without attaching to a kitchen equipment or wall.

The driving mechanism 30 of the present invention may serve to control the extending movement (or up movement) or retracting movement (or down movement) of the shielding plate 20 by wired signal control or by wireless signal control, not limited in this invention. The cooking smoke shielding and guiding apparatus may be provided with plural sets, which may be synchronously controlled and operated so as to extend or retract plural shielding plates 20 simultaneously as controlled by the plural driving mechanisms 30. For example, three shielding plates 20 may be simultaneously retracted as shown in FIG. 9.

The kitchen object F may refer to a kitchen cabinet, a kitchen counter, a housing of an exhaust system, a kitchen wall, or other kitchen equipments for installing a gas stove, a range, or an oven; not limited in this invention.

Figure 7:
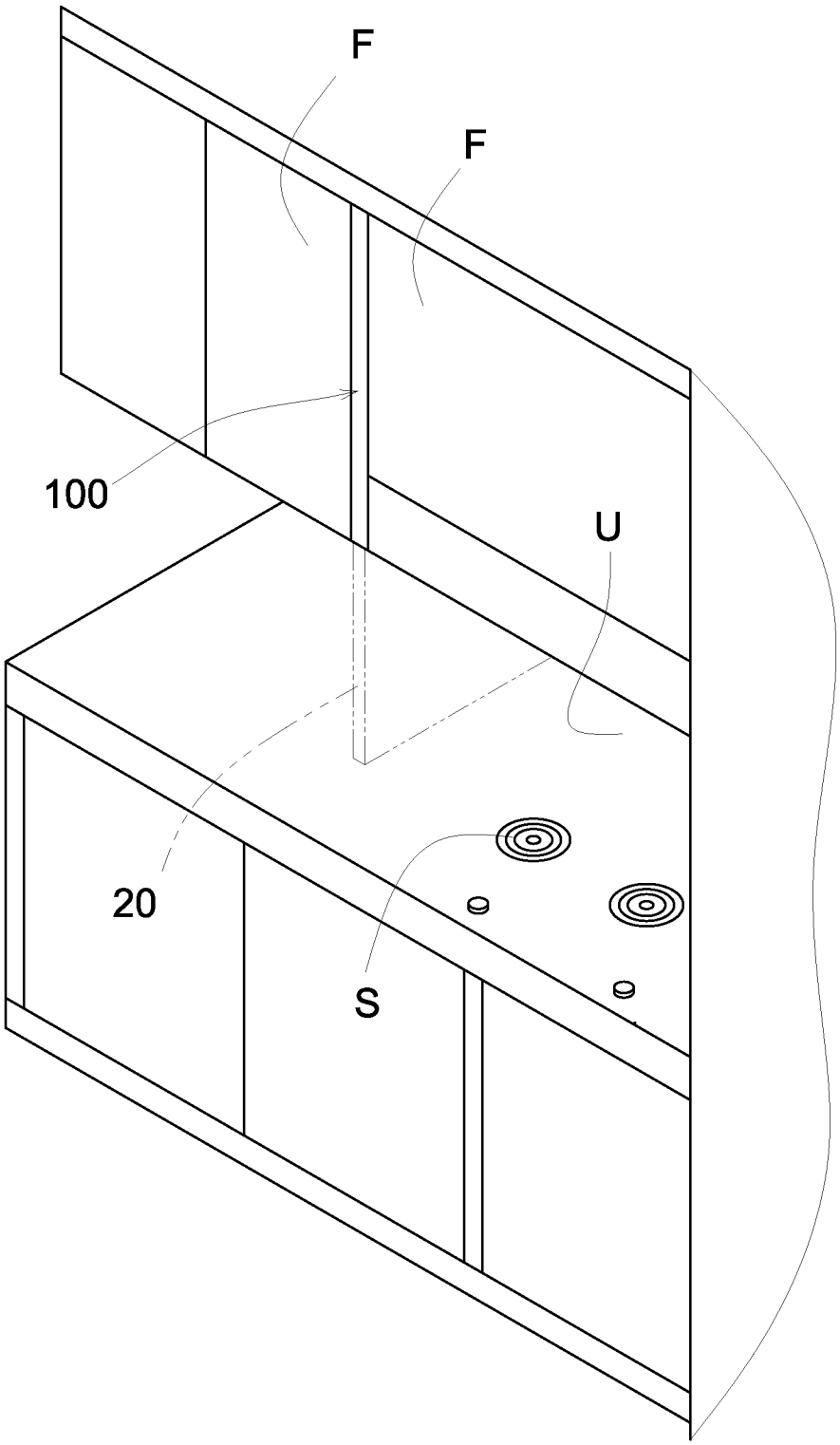
FIG. 7 shows a shielding plate provided for shielding purpose in accordance with the present invention.

As shown in FIG. 7, a cooking smoke shielding and guiding apparatus 100 may be provided in a kitchen object F to upwardly extend the shielding plate 20 to form a U-shaped "compartment" U with the neighboring walls to shield or guide a smoke or combustion waste gas of a gas stove S so as to draft the smoke or waste gas upwardly outwardly as sucked by an exhaust system (not shown), wherein the smoke or waste gas is confined within the U-shaped compartment U with minus pressure and well shielded, deflected, guided, and drafted by the shielding plate 200 and its neighboring walls upwardly outwardly as sucked by the exhaust system (which may be an exhaust fan or system). Meanwhile, the air-conditioned room air (with positive pressure) in the kitchen will also be shielded or baffled by the shielding plate 20, indicating that the interior air of the air conditioning system will be kept clean and not be mixed or contaminated by the smoke or waste gas from the gas stove S. The U-shaped compartment U may then be considered as a "duct" for discharging smoke or waste gas of the stove or range in a kitchen. The layout as shown in FIG. 7 is just a design example for implementing the apparatus of the present invention in a kitchen. The apparatus of the present invention may be served as an individual or independent unit so that it may be equipped in a kitchen to be commensurate with a gas range, stove, oven, cabinet, counter or other kitchen equipments for a satisfactory design including planning of interior systematic furnitures. The present invention may be put into a design or layout to be commensurate with the user's favorite interest or choices.

Figure 8:
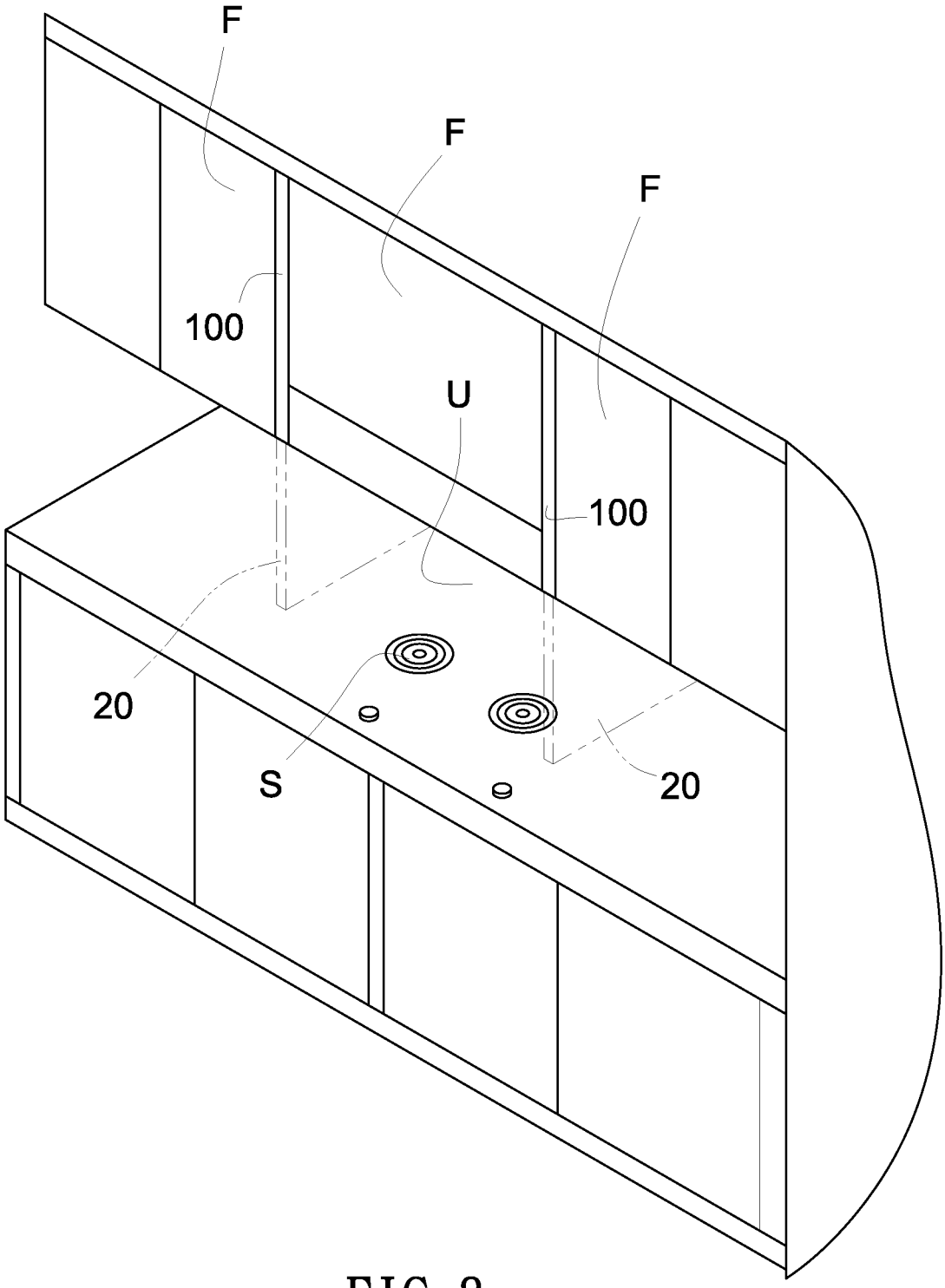
FIG. 8 shows two shielding plates provided for the present invention.

As shown in FIG. 8, two shielding plates 20 of the two smoke shielding and guiding apparatuses 100 of the present invention are extended to form a U-shaped confined compartment U around the gas stoves S, whereby the smoke or waste gas from the gas stores S will be shielded by the two shielding plates 20 and will be deflected, guided and drafted upwardly outwardly as sucked by an exhaust system (not shown) installed in a kitchen object F above the stoves. The U-shaped compartment U will form a negative pressure chamber to suck the smoke or waste gas outwardly, without contaminating the interior air in the kitchen or room. This example is provided for shielding smoke or waste gas of stoves which are installed in a kitchen area having "open space" which may easily spread smoke or waste gas sidewardly into kitchen or room to cause air pollution, if without being installed with the shielding plates 20 of the present invention.

Figure 10:
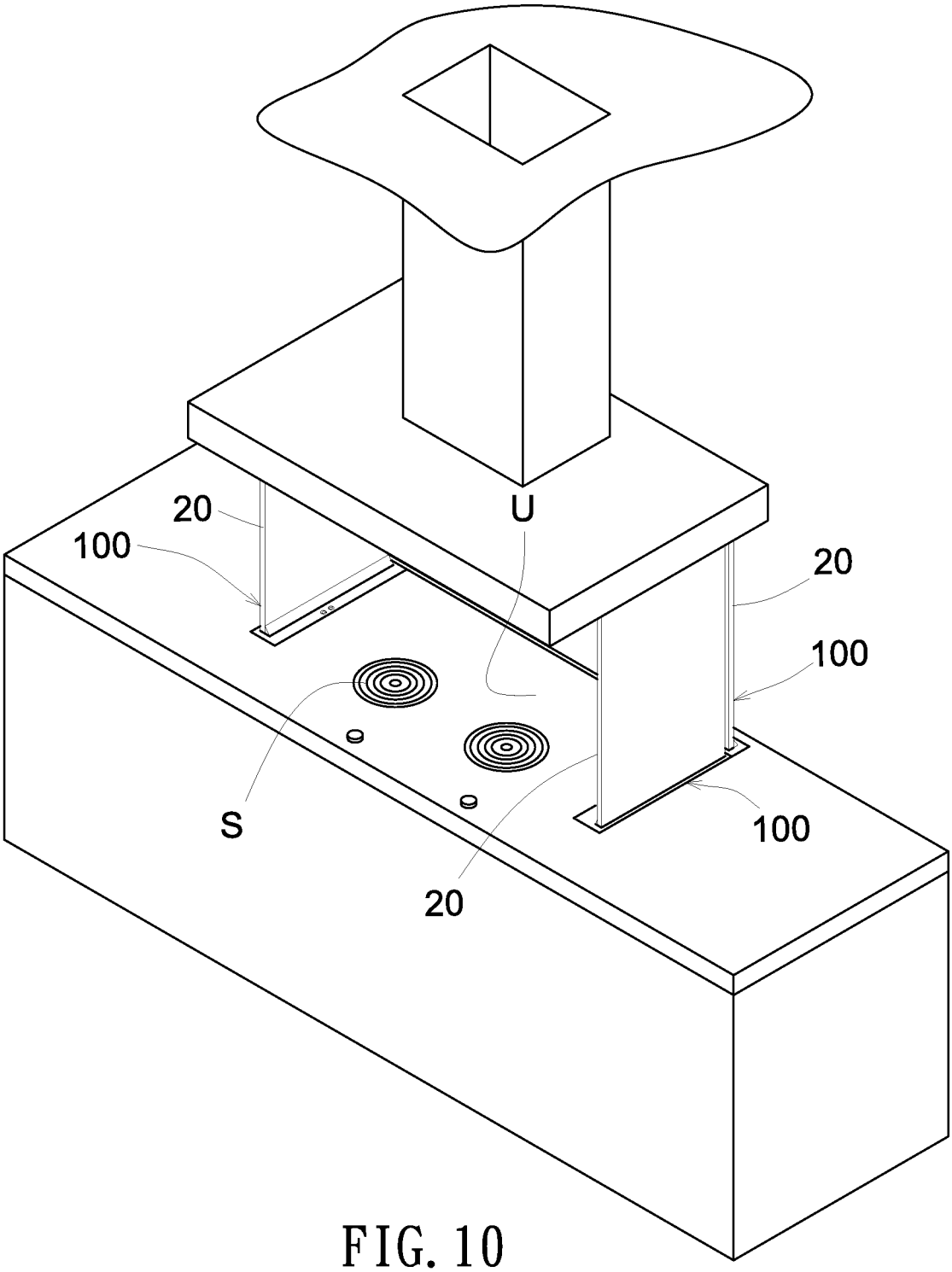
FIG. 10 shows three shielding plates upwardly extended to be communicated with an exhaust system.

As shown in FIG. 9, three shielding and guiding apparatuses 100 of the present invention may be provided to extend three shielding plates 20 outwardly to form a U-shaped compartment to confine the stoves S for shielding and guiding smoke or waste gas outwardly by an exhaust system (not shown) to prevent air pollution in a kitchen. In FIG. 9, there shows no partition or wall around the stoves S so that three apparatuses 100 and an exhaust system (not shown) should be provided for shielding and drafting smoke outwardly. As shown in FIG. 10, an exhaust system E is installed above the three shielding plates 20 of three apparatuses 100 when outwardly extended to define a U-shaped compartment U to shield and draft smoke upwardly outwardly through the exhaust system E.

The present invention may be incorporated into a systematic kitchen equipments or furnitures for well implementing kitchen equipments for the user. The cooking smoke shielding and guiding apparatus 100 may be produced as a "module" or unit for an easy handling, assembly and installation for a user to be commensurate with (or to be a part of) the kitchen equipments such as range, stove, oven, cabinet, counter, table, and exhaust system. So, this invention with its convenient uses may thus increase its commercial value. Meanwhile, by the aid of plural shielding plates 20, a smoke or waste gas "duct" may be formed to efficiently shield and draft the smoke and waste gas outwardly to keep a clean interior air and prevent air pollution in a kitchen or room. When not use for drafting smoke outwardly, the shielding plates 20 may be downwardly or inwardly retracted to reveal an open space in a kitchen. The smokes may also refer to fumes, odors or waste gas in the kitchen and will be well exhausted by the present invention.

Even though, the above-mentioned description shows a vertical extending or retracting movement of the shielding plate 20. However, the shielding plate 20 may also be provided to be extended or retracted horizontally, not limited in this invention. The shielding plate 20 may be downwardly extended or upwardly retracted. Of course, it can be vice versa, such that the shielding plate 20 may be upwardly extended or downwardly retracted by optional design choices.

The present invention may be further modified without departing from the spirit and scope of the present invention.

I claim:

1. A cooking smoke shielding and guiding apparatus comprising:

a housing including an outer casing, a storing chamber defined in said outer casing and having a slot formed in an end portion of storing chamber, and a plurality of fixing elements formed on said outer casing adapted for fixing said outer casing on a kitchen object by said fixing elements;

a shielding plate slidably retractably stored in said storing chamber of said housing or slidably extended outwardly through said slot of said outer casing for shielding and guiding cooking smoke; and a driving mechanism mounted in said storing chamber and operatively extending said shielding plate outwardly from said storing chamber, or operatively retracting said shielding plate inwardly into said storing chamber.

2. An apparatus according to claim 1, wherein said driving mechanism comprises: a driving motor, a winch driven by said driving motor; a guiding rail formed in a central portion in said housing and having a first roller rotatably mounted on a first end portion of said guiding rail and a second roller rotatably mounted on a second end portion of said guiding rail opposite to said first guiding roller; a sliding block having said shielding plate secured on said sliding block and slidably moving on said guiding rail to cooperatively move said shielding plate with respective to said guiding rail; a rope wound on said winch and having a first rope end secured to said sliding block facing towards the first end portion of said guiding rail and having a second rope end secured to said sliding block facing towards the second end portion of said guiding rail, whereby upon rotation of said driving motor and said winch either clockwise or counterclockwise, said rope will be pulled by said winch to move said sliding block and said shielding plate either towards said first end portion or towards said second and portion of said guiding rail.

3. An apparatus according to claim 1, wherein said outer casing comprises a pair of side rails disposed on opposite sides of said storing chamber for slidably moving said shielding plate along said pair of side rails.

4. An apparatus according to claim 1, wherein said housing further comprises a decorative plate covering an outer end portion of said outer casing.

5. An apparatus according to claim 4, wherein said decorative plate includes a control switch of the driving mechanism mounted on the decorative plate.

6. An apparatus according to claim 1, wherein said outer casing includes a dust-proof plate pivotally secured to said outer casing, and resiliently restored inwardly as restored by a restoring spring formed on a bottom portion of said outer casing to normally close said slot in said outer casing.

7. An apparatus according to claim 1, wherein said shielding plate is made of transparent material, and further includes an illuminator mounted on said shielding plate.

8. An apparatus according to claim 1, wherein said driving mechanism is controlled by a wired or wireless signal control.

9. An apparatus according to claim 1, wherein said shielding plate includes a display adapted for displaying a signal as input by a user into said display.

10. An apparatus according to claim 1, wherein a plurality of cooking smoke shielding and guiding apparatuses are synchronously cooperatively operated as controlled by a plurality of said driving mechanisms.

* * * * *